US009664121B2

(12) United States Patent
Park

(10) Patent No.: US 9,664,121 B2
(45) Date of Patent: May 30, 2017

(54) EXHAUST CAM NON CONNECTION ENGINE BRAKE, VEHICLE HAVING THE SAME AS AUXILIARY BRAKE, AND METHOD FOR CONTROLLING THE SAME

(71) Applicants: HYUNDAI MOTOR COMPANY, Seoul (KR); KIA MOTORS CORPORATION, Seoul (KR)

(72) Inventor: Hyung-Bin Park, Jeonju-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 184 days.

(21) Appl. No.: 14/754,540

(22) Filed: Jun. 29, 2015

(65) Prior Publication Data

US 2016/0138488 A1 May 19, 2016

(30) Foreign Application Priority Data

Nov. 13, 2014 (KR) ..... 10-2014-0158161

(51) Int. Cl.
*F02D 13/04* (2006.01)
*F01L 13/06* (2006.01)

(52) U.S. Cl.
CPC ..... *F02D 13/04* (2013.01)

(58) Field of Classification Search
CPC .... F02D 13/04; F02D 9/04; F02D 9/06; F01L 13/06; F01L 1/053; F01L 9/02
See application file for complete search history.

(56) References Cited

U.S. PATENT DOCUMENTS

| | | | | |
|---|---|---|---|---|
| 5,890,469 | A | 4/1999 | Håkansson et al. | |
| 7,520,262 | B2 * | 4/2009 | Jeong | F01L 13/06 123/320 |
| 8,813,719 | B2 * | 8/2014 | Sailer | F01L 1/053 123/321 |
| 2011/0297123 | A1 | 12/2011 | Meistrick et al. | |

FOREIGN PATENT DOCUMENTS

| | | | | |
|---|---|---|---|---|
| JP | 09-079015 | A | 3/1997 | |
| JP | 09-217615 | A | 8/1997 | |
| JP | 11-223114 | A | 8/1999 | |
| JP | 2001098913 | A * | 4/2001 | F01L 13/06 |
| JP | 2002-510770 | A | 4/2002 | |
| JP | 2007-247628 | A | 9/2007 | |
| JP | 2009-024660 | A | 2/2009 | |
| KR | 10-2001-0009310 | A | 2/2001 | |
| KR | 10-1998-0032761 | A | 11/2001 | |
| KR | 10-2001-0021890 | A | 9/2006 | |

* cited by examiner

*Primary Examiner* — Hieu T Vo
(74) *Attorney, Agent, or Firm* — McDermott Will & Emery LLP

(57) ABSTRACT

An exhaust cam non connection engine brake includes a housing body having a high pressure storing chamber which converts a low pressure oil to a high pressure oil and stores therein in order to allow the high pressure oil to flow toward an exhaust rocker arm so that the exhaust rocker arm presses an exhaust valve by the high pressure oil when an engine brake signal is applied.

16 Claims, 16 Drawing Sheets

EXHAUST CAM NON CONNECTION ENGINE BRAKE, VEHICLE HAVING THE SAME AS AUXILIARY BRAKE, AND METHOD FOR CONTROLLING THE SAME

CROSS-REFERENCE TO RELATED APPLICATION

This application claims priority to Korean Patent Application No. 10-2014-0158161, filed on Nov. 13, 2014, the entire content of which is incorporated herein by reference.

TECHNICAL FIELD

The present disclosure relates to an engine brake, and more particularly, to an exhaust cam non connection engine brake, a vehicle having the same as an auxiliary brake, and a method for controlling the same applied to a variable intake/exhaust valve system.

BACKGROUND

An engine brake, an Jake brake, and an exhaust brake, etc. have been used in commercial vehicles as an auxiliary brake to assist a foot brake with more secured braking force by reducing power transmitted to a crank shaft.

The engine brake among the above listed brakes, decelerates a vehicle by preventing driving force generation to forcibly open an exhaust valve at a compression top dead center and discharging a compressed air to atmosphere to prevent piston movement by the compressed air when an acceleration pedal is released during a four cycle (an intake stroke→a compression stroke→an explosion stroke→an exhaust stroke).

The engine brake uses negative pressure resistance acting on a piston during the intake stroke, compression resistance during the compression stroke, compression resistance during the exhaust stroke, and a mechanical friction force generated during engine rotation, as a braking force.

Such an engine brake is mounted at an upper portion of an engine and connected to an exhaust cam, an exhaust rocker arm, intake/exhaust valves, and an engine oil circulation structure of a cylinder head.

However, the engine brake can only be mounted in the engine at which an exhaust cam having a protrusion is applicable since movement of the exhaust rocker arm pressing down the exhaust valve before reaching the compression top dead center is directly connected with the exhaust cam having the protrusion.

Accordingly, an improved variable intake/exhaust valve system capable of satisfying the fuel efficiency has been applied to the engine brake connected with the engine cam having the protrusion.

However, the compression top dead center of the exhaust cam having the protrusion in the variable intake/exhaust valve system cannot be determined.

SUMMARY

The present disclosure has been made in an effort to solve the above problems, and provides an exhaust cam non connection engine brake, a vehicle having the same as an auxiliary brake, and a method for controlling the same in which an exhaust valve is operated by an exhaust rocker arm through a high pressure oil passage formed by a control signal of an controller, thereby capable of applying to all valve system including a variable intake/exhaust valve system which cannot determine a compression top dead center using an exhaust cam, and particularly, an exhaust brake is applied to a vehicle as an auxiliary brake along with the exhaust cam non connection engine brake, thereby expanding the usage area of the exhaust brake for an engine cooling water temperature rising operation in addition to a brake operation.

An exhaust cam non connection engine brake according to an embodiment of the present inventive concept may include a housing body having a high pressure storing chamber which converts a low pressure oil to a high pressure oil and stores therein in order to allow the high pressure oil to flow toward an exhaust rocker arm so that the exhaust rocker arm presses an exhaust valve by the high pressure oil when an engine brake signal is applied.

The housing body may further include a regulation valve installed at a relief oil line and relieving an overpressure of the high pressure storing chamber.

A vehicle having an exhaust cam non connection engine brake as an auxiliary brake according to another embodiment of the present inventive concept may include a variable valve system mounted at a cylinder head of an engine and including an exhaust cam, an exhaust rocker arm, an intake valve, an exhaust valve, a cam cap, and a cam shaft to vary an opening time between the exhaust valve and the intake valve for each engine revolutions per minute (RPM). An exhaust cam non connection engine brake converts a low pressure oil to a high pressure oil to supply the high pressure oil toward the exhaust rocker arm so that the exhaust rocker arm presses the exhaust valve by the high pressure oil when an engine brake signal is applied. An electronic control unit (ECU) controls the variable valve system and has a compression top dead center electric signal application map for an engine brake operation and release control.

A vehicle having an exhaust cam non connection engine brake as an auxiliary brake according to another embodiment of the present inventive concept may include a variable valve system mounted at a cylinder head of an engine and including an exhaust cam, an exhaust rocker arm, an intake valve, an exhaust valve, a cam cap, and a cam shaft to vary an opening time between the exhaust valve and the intake valve for each engine RPM. An exhaust cam non connection engine brake converts a low pressure oil to a high pressure oil to supply the high pressure oil toward the exhaust rocker arm so that the exhaust rocker arm presses the exhaust valve by the high pressure oil when an engine brake signal is applied. An exhaust brake is connected to an exhaust pipe which discharges exhaust gas from the engine. An ECU controls the variable valve system and the exhaust brake and has a compression top dead center electric signal application map for an engine brake operation and release control.

A method for controlling an exhaust cam non connection engine brake as an auxiliary brake according to still another embodiment of the present inventive concept may include recognizing an engine RPM, IG on state, an atmosphere temperature, and a vehicle speed by an ECU. Whether the atmosphere temperature is less than a predetermined temperature, the vehicle speed is 0 (zero), and the engine RPM is more than 1,000 rpm during the IG on state and an engine cooling water temperature rising control state by operating an exhaust brake is determined.

The exhaust brake may be operated so that hot exhaust gas from an engine due to blockage of an exhaust pipe by an exhaust brake valve may flow backward to a combustion chamber of the engine.

The engine brake of the present disclosure may be applied to a variable intake/exhaust valve system since movement of the exhaust rocker arm opening the exhaust valve is achieved without determining a compression top dead center position using the exhaust cam and may have an effect that contributes to enhance the performance of the vehicle with fuel efficiency improved by the variable intake/exhaust valve system.

Furthermore, the engine brake of the present disclosure can be applied to any kind of valve system since the movement of the exhaust rocker arm opening the exhaust valve is connected to the high pressure oil passage by the ECU, and the engine brake operation can determine compression top dead center position using the exhaust cam.

Also, the engine brake of the present disclosure can use both auxiliary brake operation and engine cooling water heating operation by applying to the vehicle as the auxiliary brake along with the exhaust brake.

DESCRIPTION OF SPECIFIC EMBODIMENTS

Figure 1:
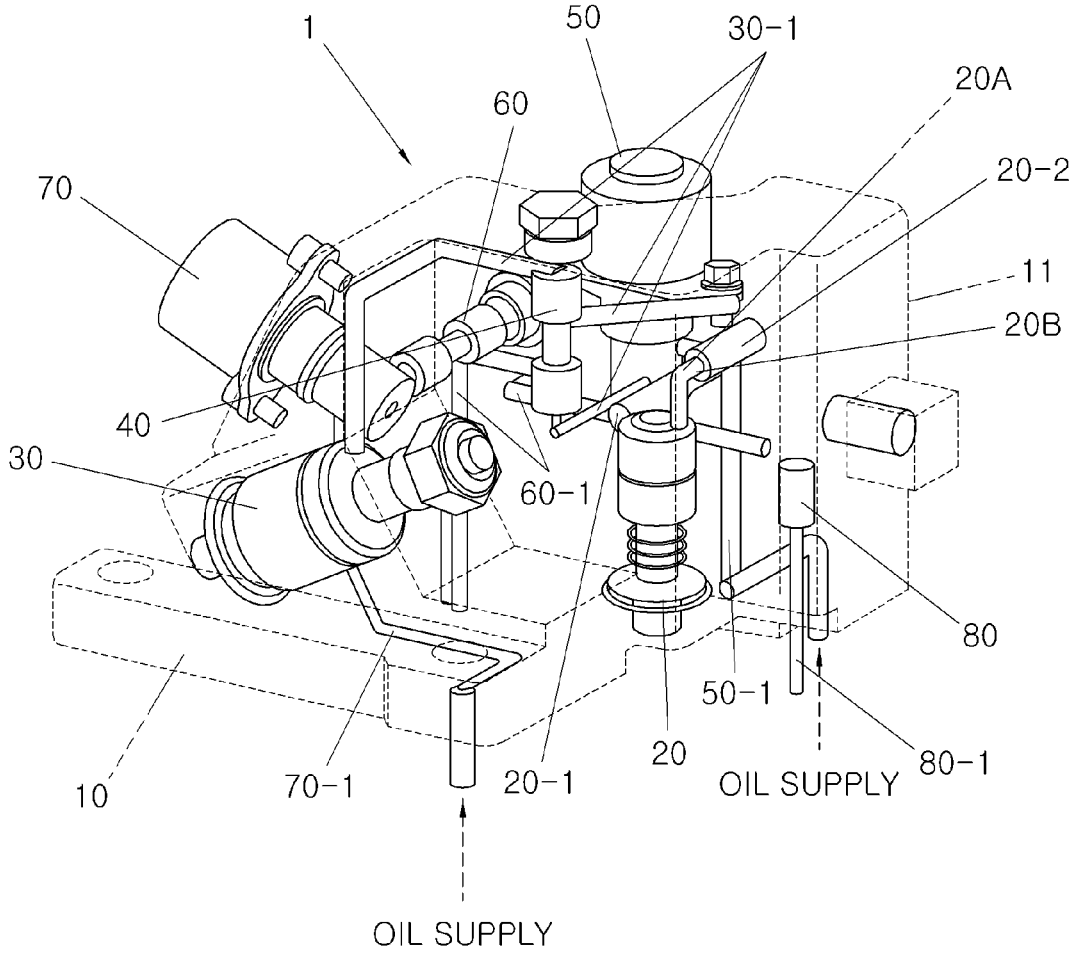
FIG. 1 is a block diagram of an exhaust cam non connection type engine brake according to the present disclosure.

FIG. 1 shows an exhaust cam non-connection engine brake according to an exemplary embodiment of the present inventive concept.

As shown, an exhaust cam non connection engine brake 1 may include a housing body 10 having a high pressure storing chamber 11. A master piston 20 generates a high pressure oil for operating the engine brake 1. A slave piston 30 opens an exhaust valve with the high pressure oil when the engine brake 1 operates. Multiple valves 40, 50, 60, 70 control the oil flow associated with engine brake operation and release. Oil circulating passages 20-1, 30-1, 50-1, 60-1, 70-1, 80-1 are passages through which the oil associated with the engine brake operation and release flows.

The housing body 10 may have a mounting hole for coupling a part and may have a shape appropriate for coupling. The part to be coupled is a cylinder head.

The master piston 20 converts a low pressure oil supplied at a first oil inflow line 50-1 to the high pressure oil, and then, supplies it to the high pressure storing chamber 11 through a master oil line 20-1. The master oil line 20-1 is divided into a low pressure line and a high pressure line, and each line has a first check valve and a second check valve 20A, 20B. The slave piston 30 receives the high pressure oil through a slave oil line 30-1 in order to open the exhaust valve.

The multiple valves 40, 50, 60, 70 may be first and second shuttle valves 40, 60, a high speed valve 50, a low speed valve 70, and a regulation valve 80, and installed at the housing body 10. The first shuttle valve 40 is connected with the slave oil line 30-1 and sends the high pressure oil flowing out from the high pressure storing chamber 11 to the slave piston 30 by the control of the high speed valve 50 when the engine brake 1 operates. The high speed valve 50 is connected with the slave oil line 30-1 and the first oil inflow line 50-1 and controls the first shuttle valve 40 when the engine brake 1 operates. The second shuttle valve 60 is connected with an oil discharge line 60-1 and discharges the high pressure oil flowing out from the high pressure storing chamber 11 by the control of the low speed valve 70 when the engine brake 1 is released. The low speed valve 70 is connected with a second oil inflow line 70-1 and controls the second shuttle valve 60 when the engine brake 1 is released. The regulation valve 80 is connected with a relief oil line 80-1 and relieves overpressure of the high pressure storing chamber 11.

The oil circulating passages 20-1, 30-1, 50-1, 60-1, 70-1, 80-1 may be formed at the housing body 10 and include the master oil line 20-1, the slave oil line 30-1, the first oil inflow line 50-1, the oil discharge line 60-1, the second oil inflow line 70-1, and the relief oil line 80-1. The low pressure oil entering into the oil circulating passages is supplied at a cam cap installed on the cylinder head, and the high pressure oil flowing out from the oil circulating passages is discharged to the cylinder head. The master oil line 20-1 is branched from the first oil inflow line 50-1, and divided into a line connected to the master piston 20 for the low pressure oil to enter and a line connected to the high pressure storing chamber 11 for the high pressure oil to leave. Each line has the first and second check valves 20A, 20B in order to form one way flow. The slave oil line 30-1 sends the high pressure oil to the slave piston 30 through the high pressure storing chamber 11, the high speed valve 50, and the first shuttle valve 40, thereby providing operating pressure of the slave piston 30 for pressing the exhaust valve when the engine brake 1 operates. The first oil inflow line 50-1 is connected to the high speed valve 50, thereby providing the operating pressure of the high speed valve 50 for controlling the first shuttle valve 40 when the engine brake 1 operates. The oil discharge line 60-1 is connected with the second shuttle valve 60, thereby discharging the high pressure oil flowing out of the housing body 10 by opening the second shuttle valve 60 through the control of the low speed valve 70 when the engine brake 1 is released. The second oil inflow line 70-1 is connected with the low speed valve 70, thereby providing the operating pressure of the low speed valve 70 for controlling the second shuttle valve 60 when the engine brake 1 is released. The relief oil line 80-1 is open toward the regulation valve 80 by discharging the oil of the high pressure storing chamber 11 out of the housing body 10 so that an overpressure more than a predetermined pressure formed in the high pressure storing chamber 11 is relieved.

Figure 2:
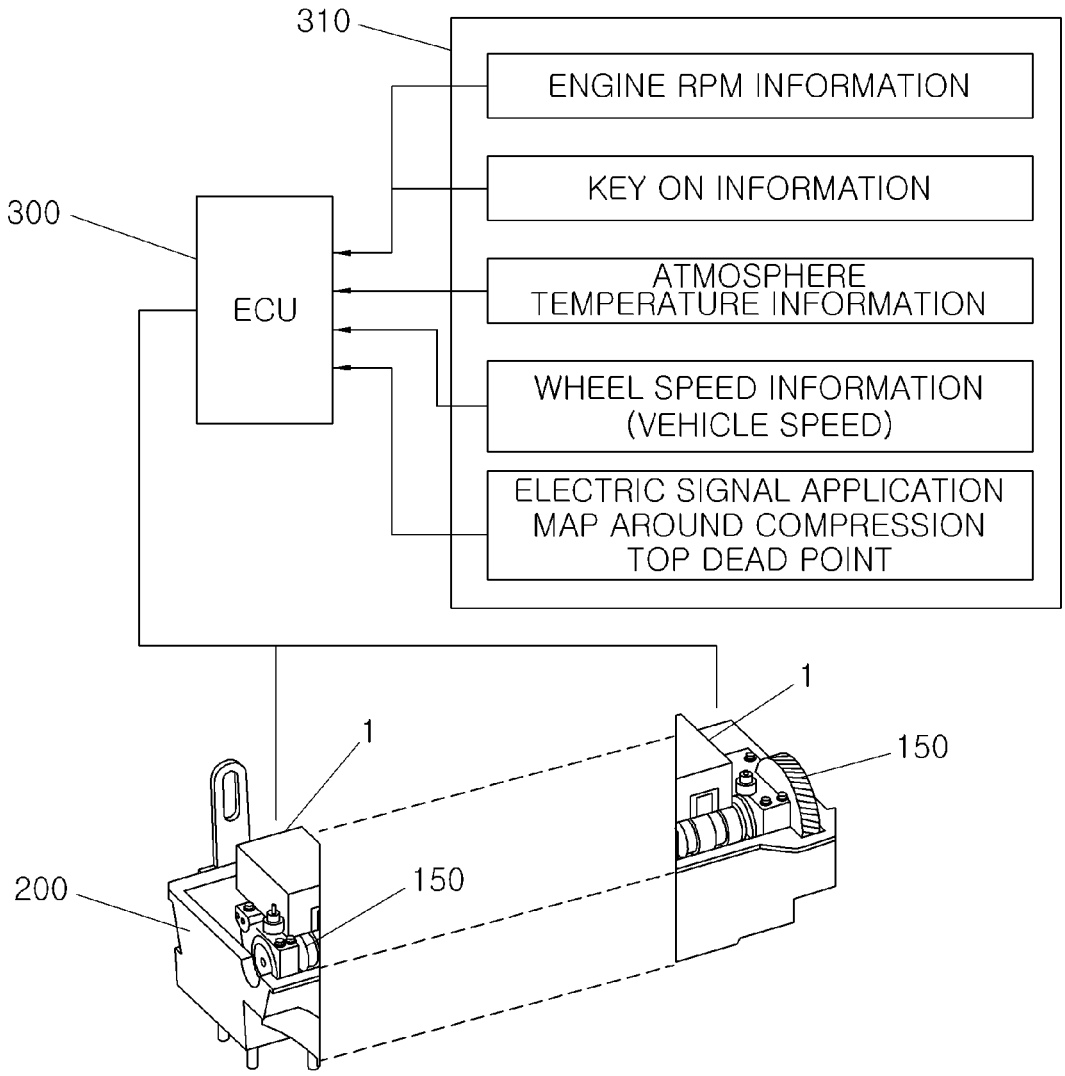
FIG. 2 is an inner block diagram of an exhaust cam non connection type engine brake and a variable intake/exhaust type engine according to the present disclosure.
Figure 3:
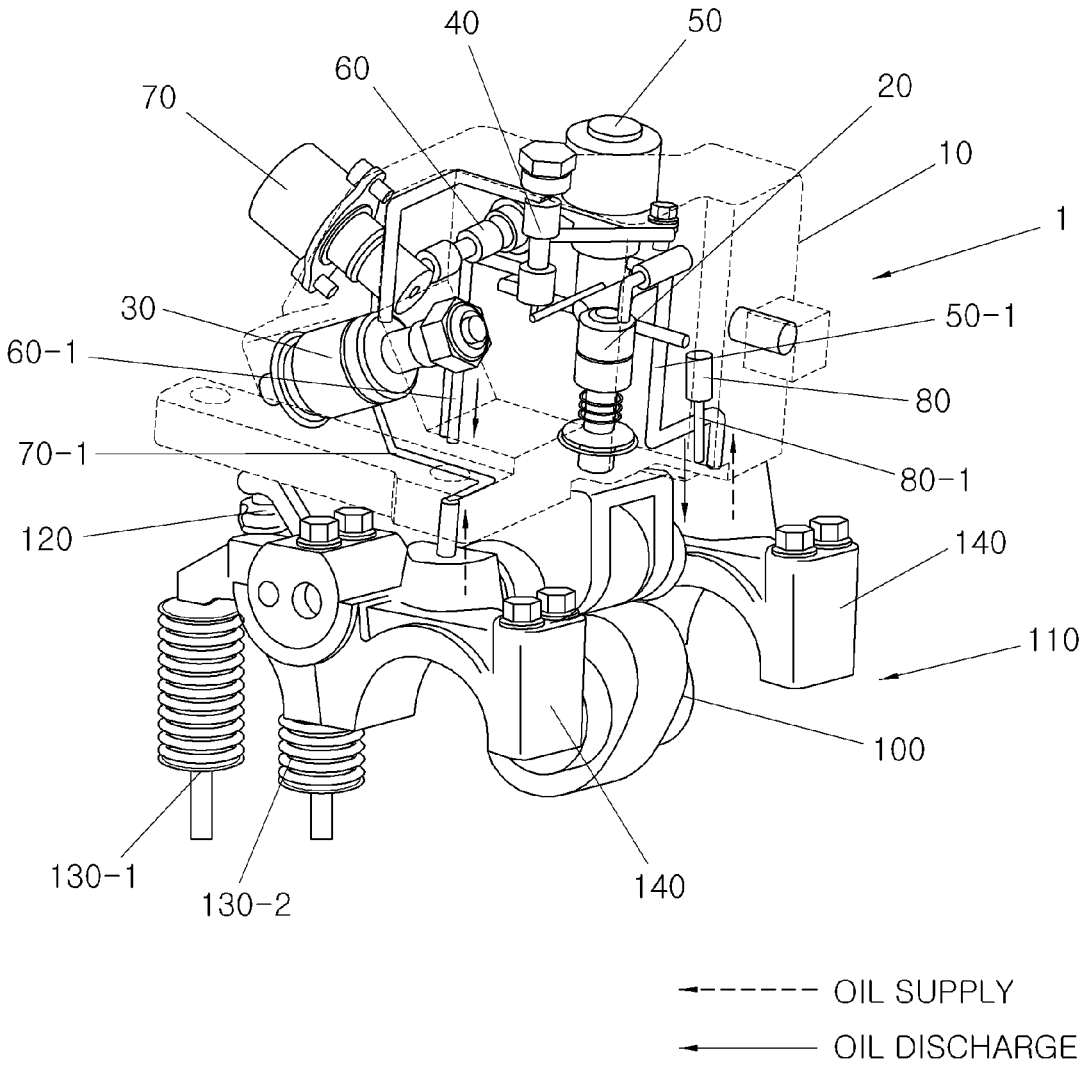
FIG. 3 is a block diagram of a variable intake/exhaust system to which an exhaust cam non connection type engine brake according to the present disclosure is applied.
Figure 4A:
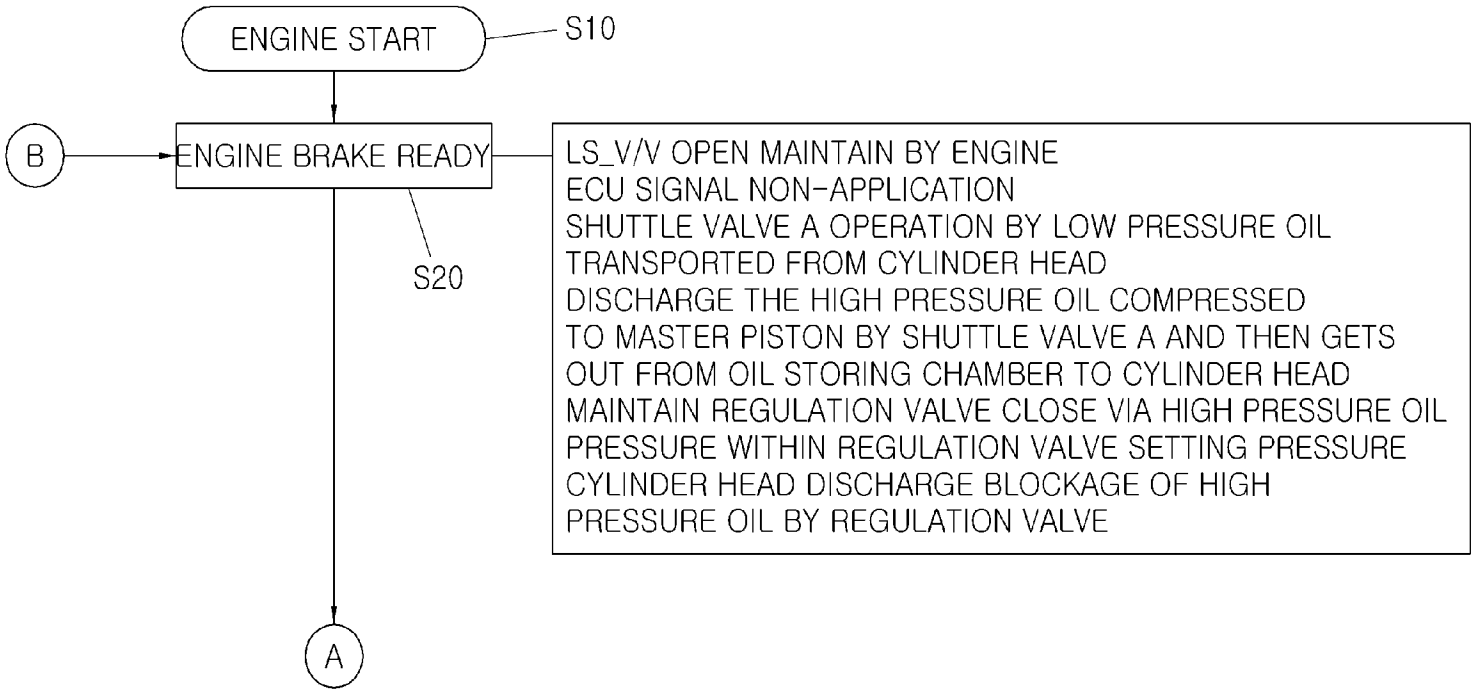
FIGS. 4A, 4B, 4C and 5 are an example of an engine brake control of a vehicle according to the present disclosure, respectively.
Figure 4B:
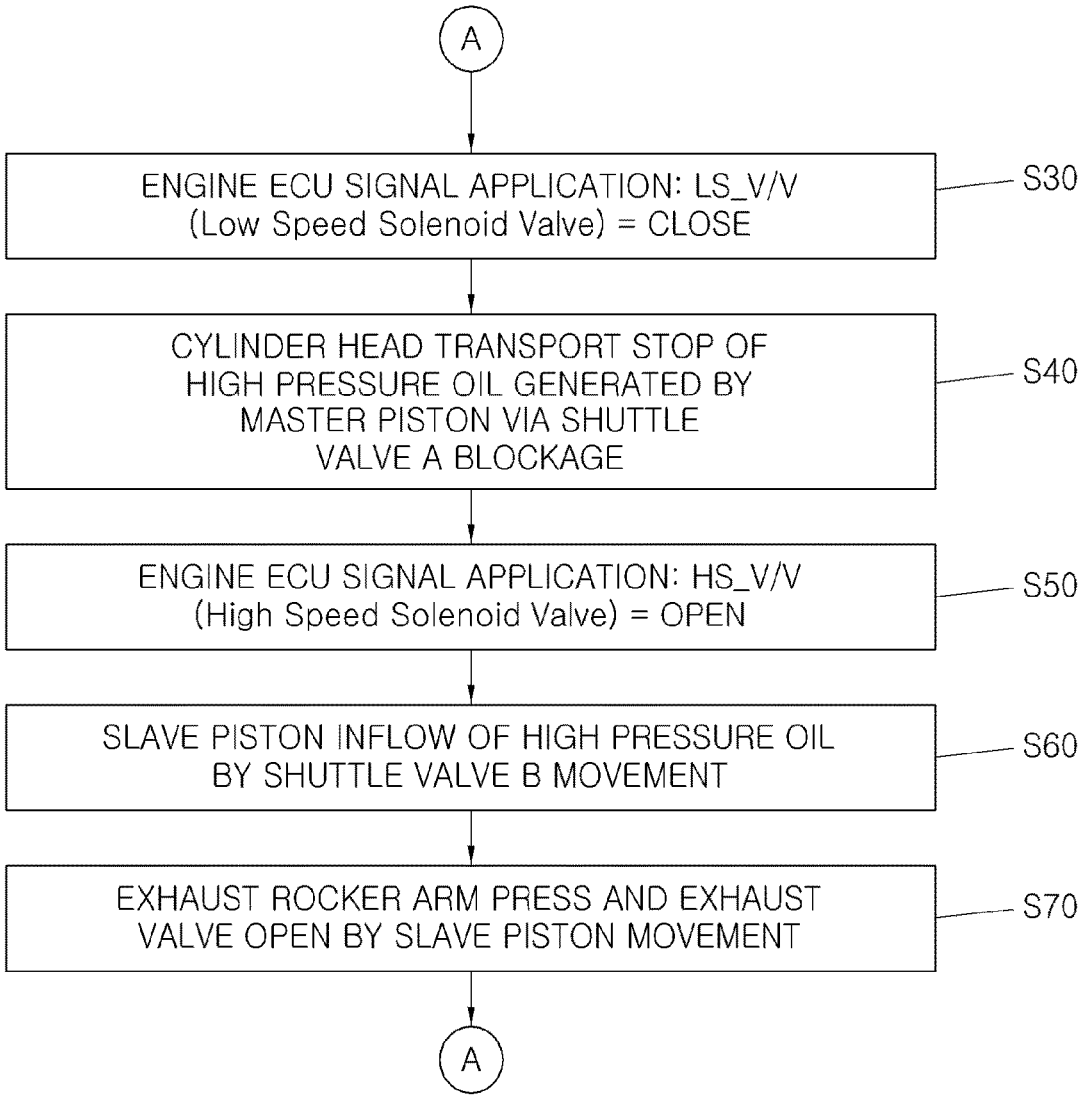
Figure 4C:
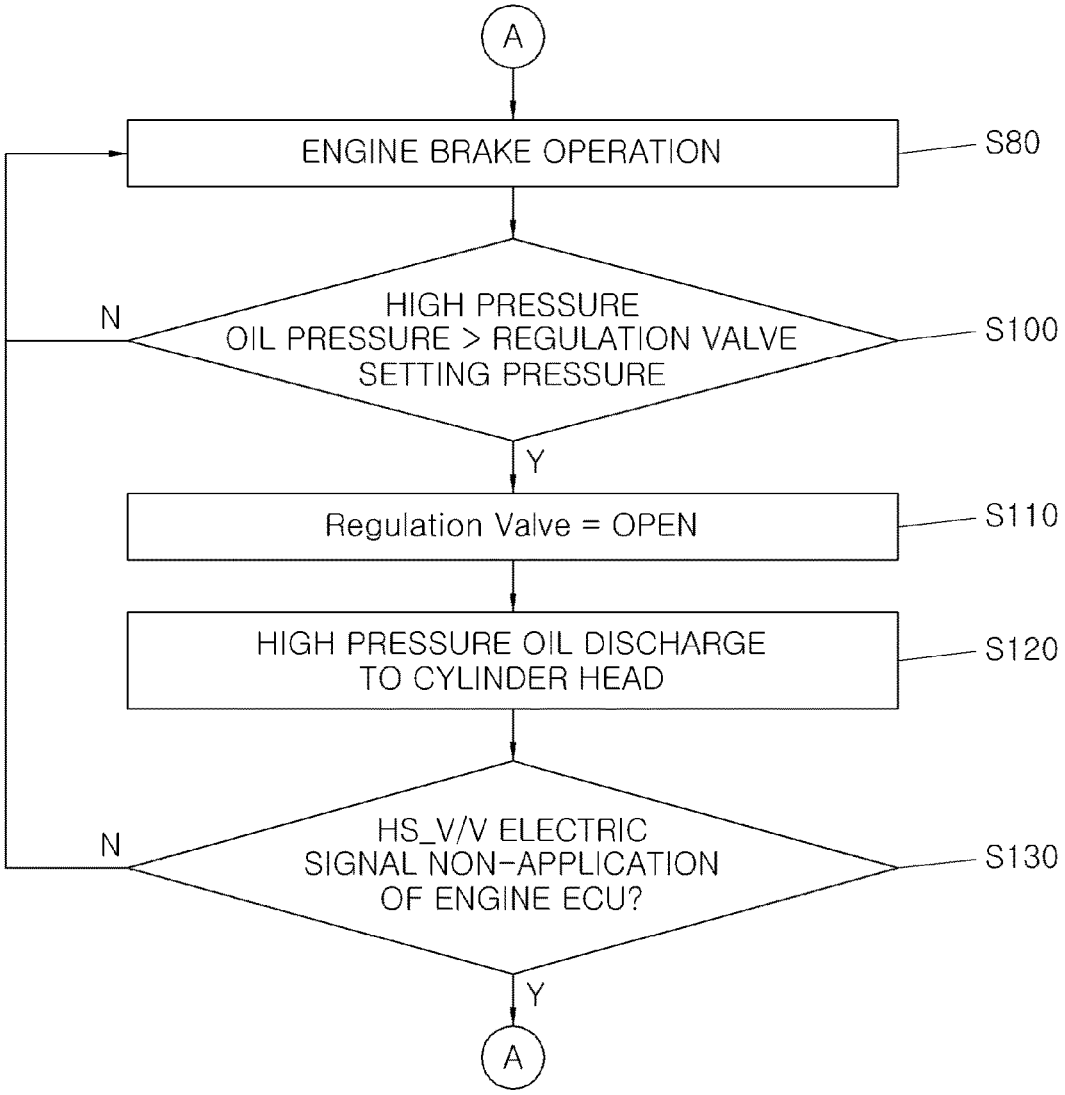
Figure 5:
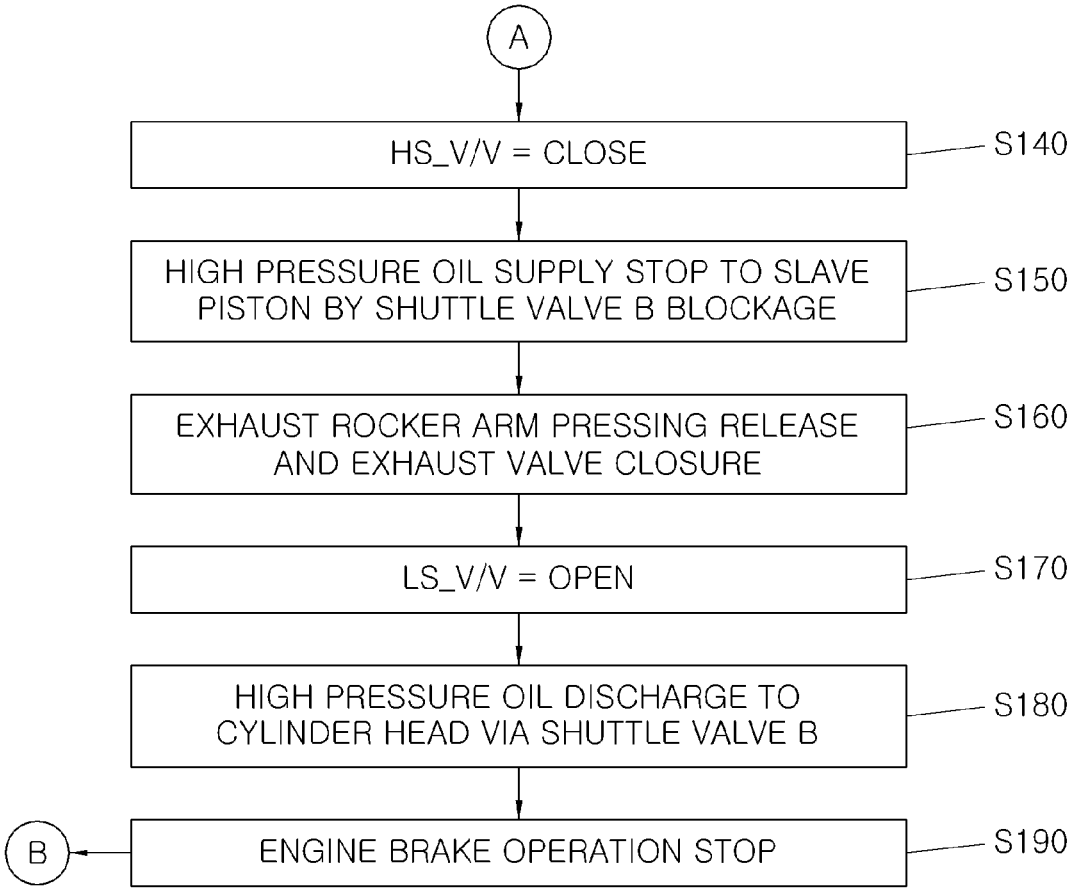

FIGS. 2 and 3 illustrate mounting states of an engine brake 1 and a variable valve system 100 at a cylinder head 200 forming an engine.

As shown, the variable valve system 100 is a variable intake/exhaust system varying an opening time between the exhaust valve and the intake valve for each engine revolutions per minute (RPM). The variable valve system 100 may include an exhaust cam 110, an exhaust rocker arm 120, first and second exhaust valves 130-1, 130-2 (the first and second intake valves are not shown), a cam cap 140, and a cam shaft 150, and these elements are equal to the elements applied to a commercial vehicle engine. The engine brake 1 is an exhaust cam non connection engine brake comprising the housing body 10, the high pressure storing chamber 11, the master piston 20, the slave piston 30, the multiple valves 40, 50, 60, 70, and the oil circulating passage 20-1, 30-1, 50-1, 60-1, 70-1, 80-1 as described above referring to FIG. 1. Further, an electronic control unit (ECU) 300 controls the variable valve system 100 and is connected with the engine brake 1 to achieve independent engine brake operation and release not to be connected with the exhaust cam 110. The ECU 300 has the engine RPM, key on (or IG on), atmosphere temperature information, wheel speed information (vehicle speed), and ECU data 310 having a compression top dead center electric signal application map. Particularly, the compression top dead center electric signal application map applies an electric signal to the high speed valve 50 around the compression top center.

Therefore, the engine brake 1 and the variable valve system 100 do not have a mechanical connection structure such as the exhaust cam and a protrusion, but may be only connected so that oil may be supplied to the first and second oil inflow lines 50-1, 70-1 through an oil hole penetrated at the cam cap 140, and the high pressure oil coming out from the relief oil line 80-1 may be discharged to the cylinder head 200.

FIGS. 4A, 4B, 4C, and 5 show engine brake control logic of the ECU 300 for controlling the engine brake 1 applied to a vehicle. Hereafter, "Master Piston" means the master piston 20, "Slave Piston" means the slave piston 30, "HS_V/V (High Speed Solenoid Valve)" means the high speed valve 50, "Shuttle Valve B" means the first shuttle valve 40, "Shuttle Valve A" means the second shuttle valve 60, "LS_V/V (Low Speed Solenoid Valve)" means the low speed valve 70, "Regulation Valve" means the regulation valve 80, "oil storing chamber" means the high pressure storing chamber 11, and "Cylinder Head" means the cylinder head 200, respectively.

In step S10, an engine ignition is recognized at the ECU 300, and then, the ECU 300 enters an engine brake ready state for operating the engine brake to maintain the engine brake 1 at a standby state for operating the engine brake 1. In the engine brake ready state, the engine brake 1 is divided into an engine brake normal operation according to steps S30 to S120 and an engine brake return operation according to steps S130 to S180 by an engine brake operation signal application of the ECU 300.

An operation state of the engine brake 1 according to the engine brake ready state at step S20 is LS_V/V OPEN, Shuttle Valve A operation, Cylinder Head discharge of the high pressure oil, and Regulation Valve CLOSE. Such an engine brake operation according to the engine brake ready state is described in FIGS. 6A and 6B.

Figure 6A:
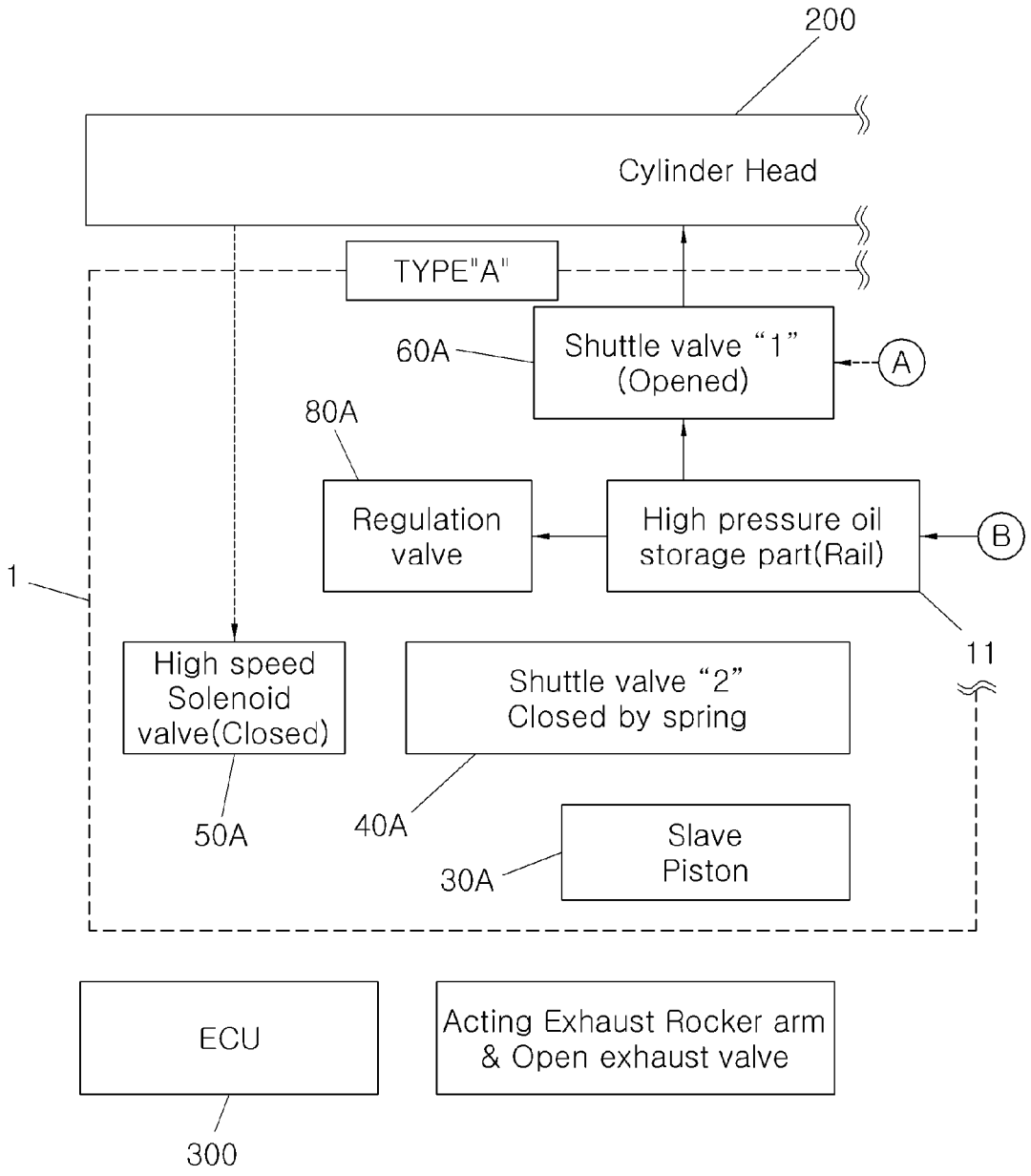
FIGS. 6A and 6B show a non-operation state of an exhaust cam non connection engine brake according to the present disclosure.
Figure 6B:
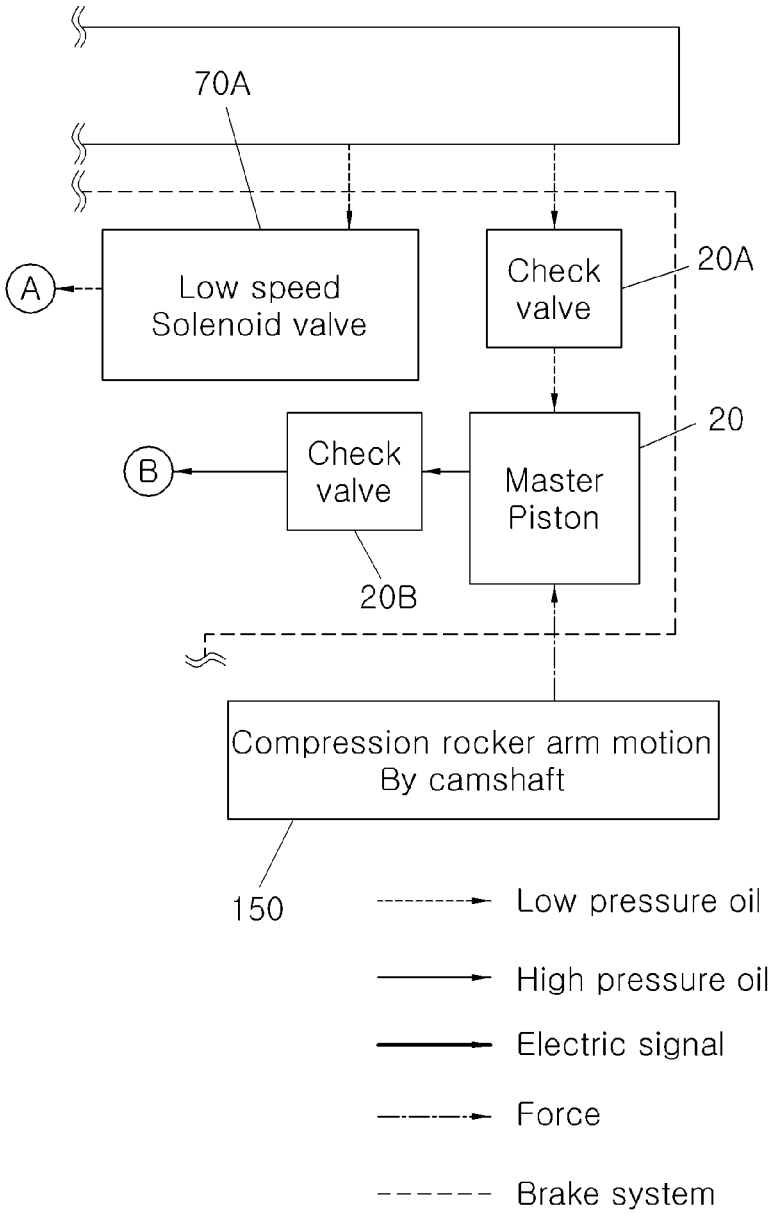

Referring to FIGS. 6A and 6B, the LS_V/V 70 maintains LS_V/V OPEN by an engine brake operation signal non-application so that the low pressure oil enters the second oil inflow line 70-1 connected to the cam cap 140, and the Shuttle Valve A 60 is operated by the low pressure oil from the cylinder head 200 through the cam cap 140. Then, the high pressure oil which is generated at the master piston 20 by the Shuttle Valve A 60 and thereafter come out from the oil storing chamber is discharged to the cylinder head 200 through the oil discharge line 60-1. Further, since the pressure of the high pressure oil in the oil storing chamber is within a setting pressure, the regulation valve 80 maintains a close state so that the discharging to the cylinder head 200 of the high pressure oil generated at the master piston 20 may be shut off.

Figure 7A:
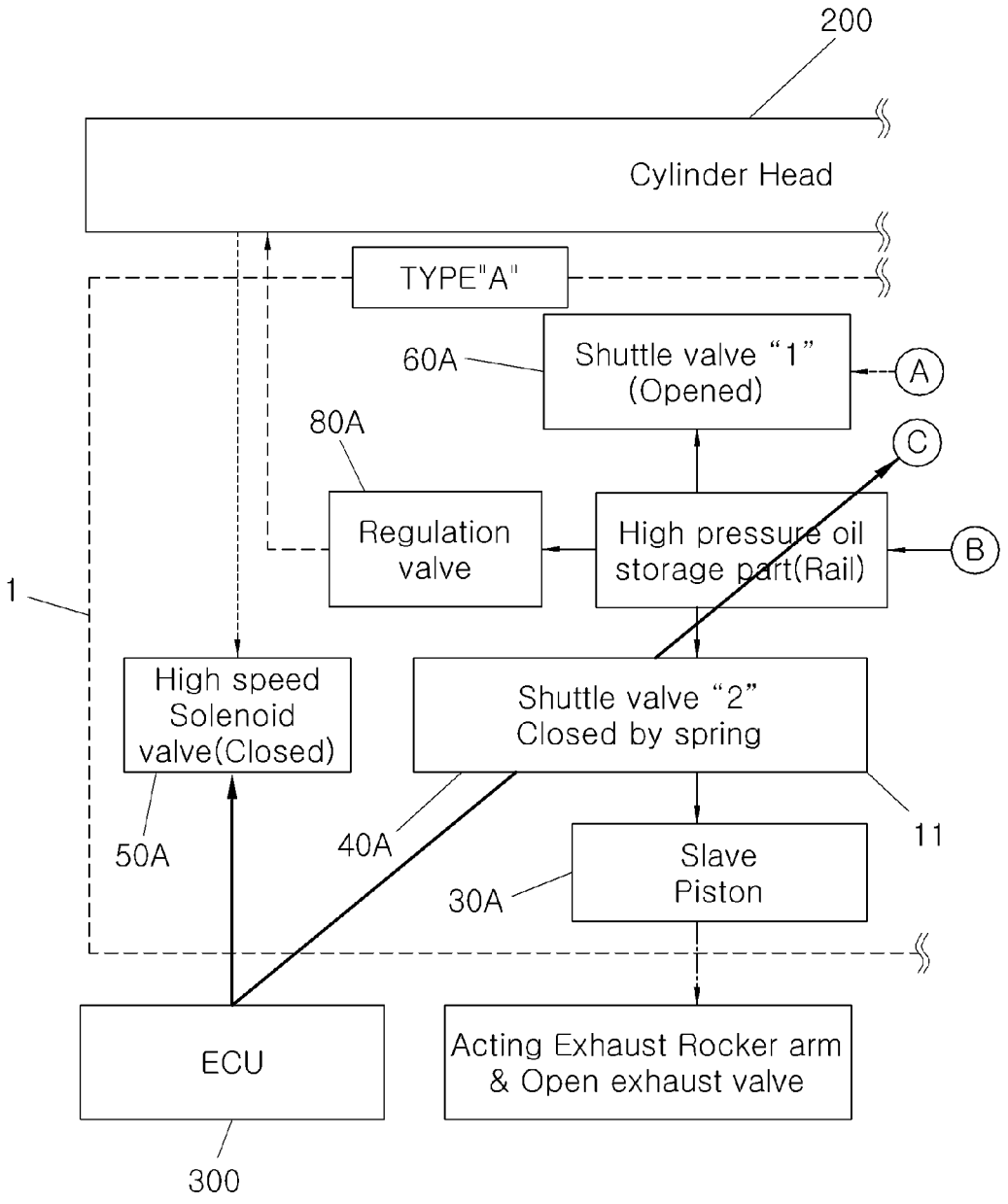
FIGS. 7A and 7B show an operation state of an exhaust cam non connection engine brake according to the present disclosure.
Figure 7B:
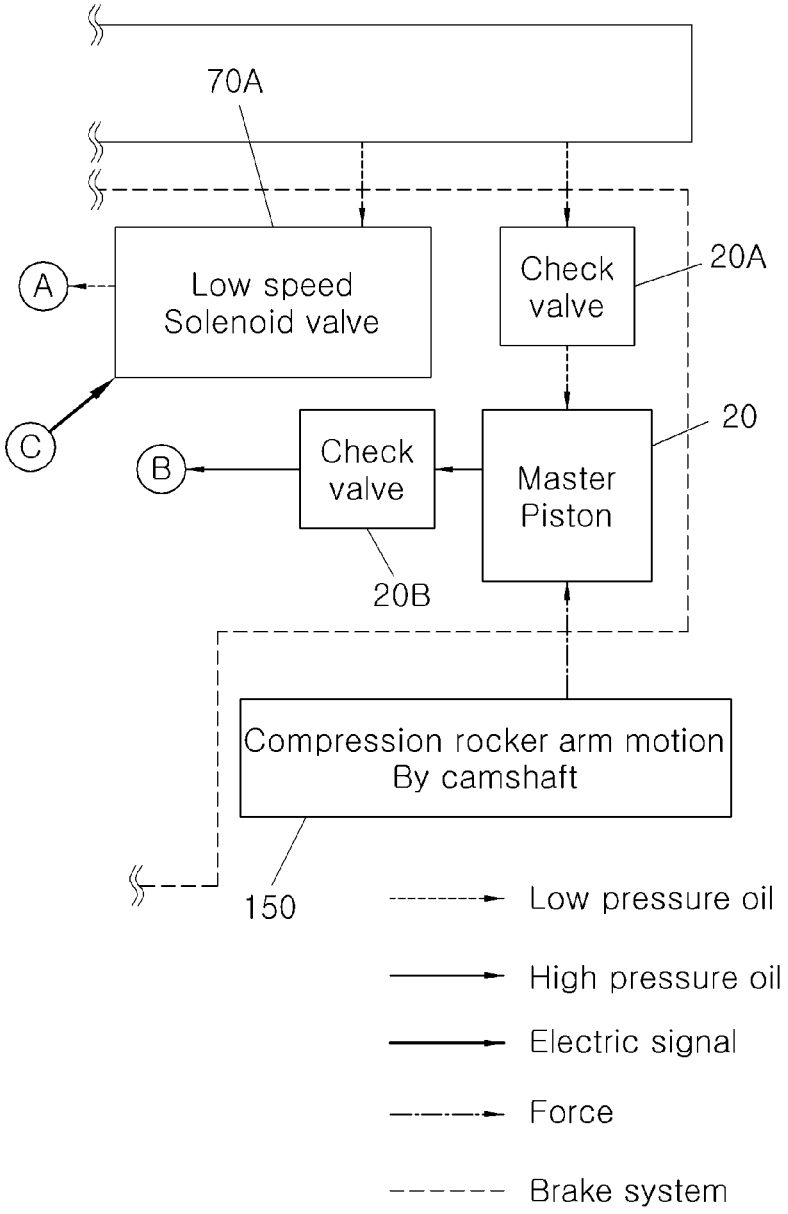

The engine brake operation according to steps S30 to S120 will be described with FIGS. 7A and 7B showing the engine brake operation. Referring to FIGS. 7A and 7B, the ECU 300 applies an engine brake operation signal to LS_V/V 70 so that LS_V/V 70 is closed at step S30. At this time, the engine brake operation signal application is achieved by applying an electric signal around the compression top dead center through the compression top dead center electric signal application map of the ECU data 310. Then, low pressure oil supply is shut off by LS_V/V 70 through the second oil inflow line 70-1 so that the shuttle valve A 60 is blocked. The block of the shuttle valve A 60 closes the oil discharge line 60-1 so that the high pressure oil generated by the master piston 20 is not supplied to the cylinder head 200 at step S40. Subsequently, the ECU 300 applies the engine brake operation signal to HS_V/V 50 so that HS_V/V 50 is opened at step S50. At this time, the engine brake operation signal application is achieved by applying an electric signal around the compression top dead center through the compression top dead center electric signal application map of the ECU data 310. Then, the shuttle valve B 40 moves by the low pressure oil flowed into the first oil inflow line 50-1 connected with cam cap 140 so that the high pressure oil of the high pressure storing chamber 11 is supplied to the slave oil line 30-1 and then the high pressure oil flows into the slave piston 30 through the slave oil line 30-1 at step S60. As a result, the slave piston 30 moves to press the exhaust rocker arm 120 so that the first and second exhaust valves 130-1, 130-2 are open at step S70 and the engine brake is operated in S80. When the pressure of the high pressure oil is more than a regulation valve setting pressure of regulation valve 80 at step S100, the regulation valve 80 is opened at step S110 and the high pressure oil over the setting pressure is discharged to cylinder head 200 by opening the regulation valve at step S120. As such, an interior of the engine brake 1 may be secured safely against the excessive oil pressure by the operation of the regulation valve 80.

Figure 8A:
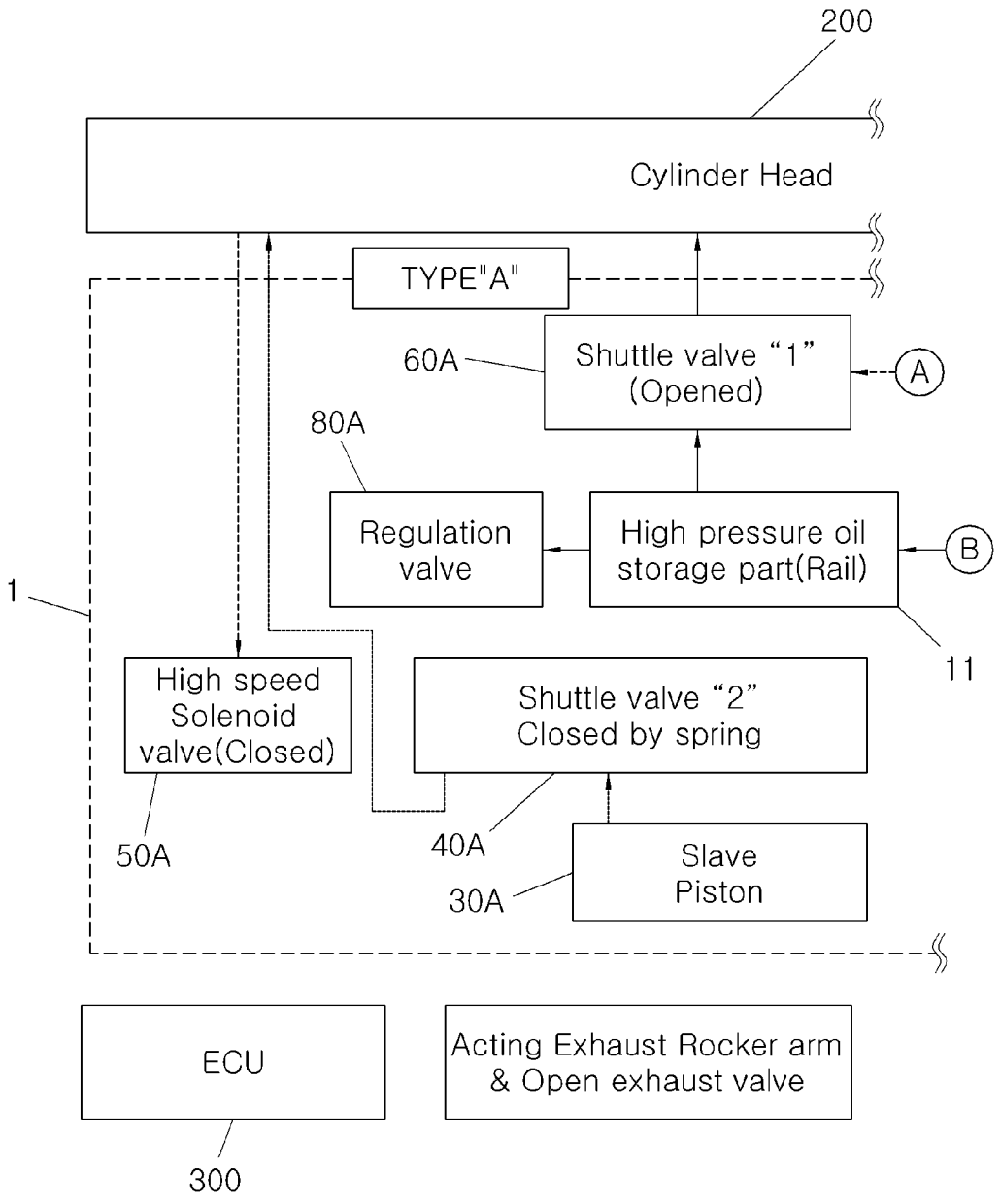
FIGS. 8A and 8B show a stop state after an exhaust cam non connection engine brake according to the present disclosure is operated.
Figure 8B:
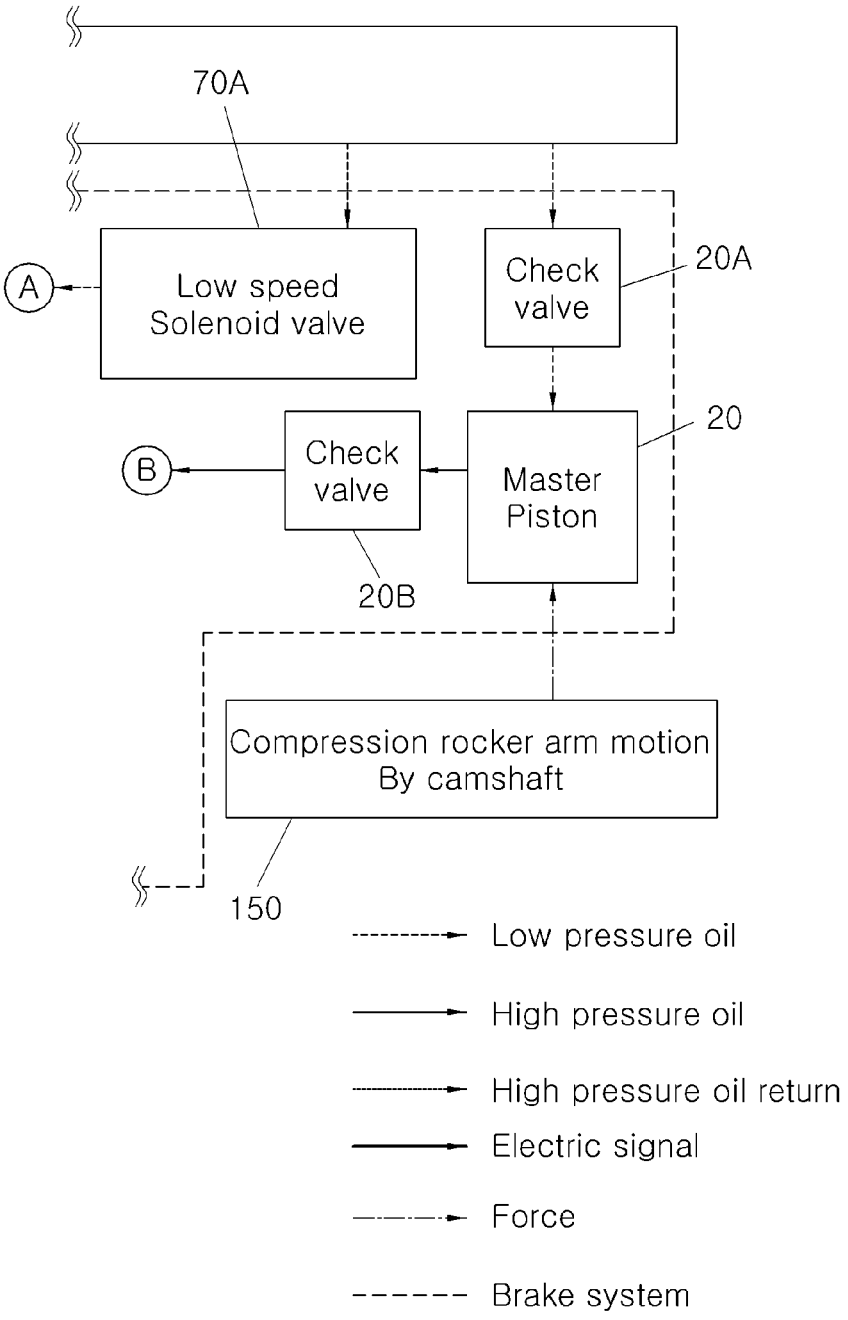

The engine brake return operation of steps S130 to S180 will be described with FIGS. 8A and 8B showing the return operation of the engine brake 1. Referring to FIGS. 8A and 8B, the ECU 300 blocks the electric signal output to HS_V/V 50 so that HS_V/V 50 is converted to close at step S140. Then, the low pressure oil flowing into the first inflow line 50-1 is blocked so that the shuttle valve B 40 returns to its initial position, thereby blocking the high pressure oil supply of the slave oil line 30-1 at step S150, by which the slave piston 30 returns to its initial position for the exhaust rocker arm 120 for the first and second exhaust valve 130-1, 130-2 to be closed at step S160. Subsequently, the ECU 300 applies an electric signal to LS_V/V 70 to open LS_V/V at step S170. Then, the low pressure oil flows into the second oil inflow line 70-1 to generate the position return of shuttle valve A 60 so that the high pressure oil remaining in the slave piston 30 is discharged to the cylinder head 200 through the oil discharge line 60-1 at step S180. As a result, the engine brake 1 is shut down, thereby entering into the engine brake ready of steps S20 and S190.

Figure 9:
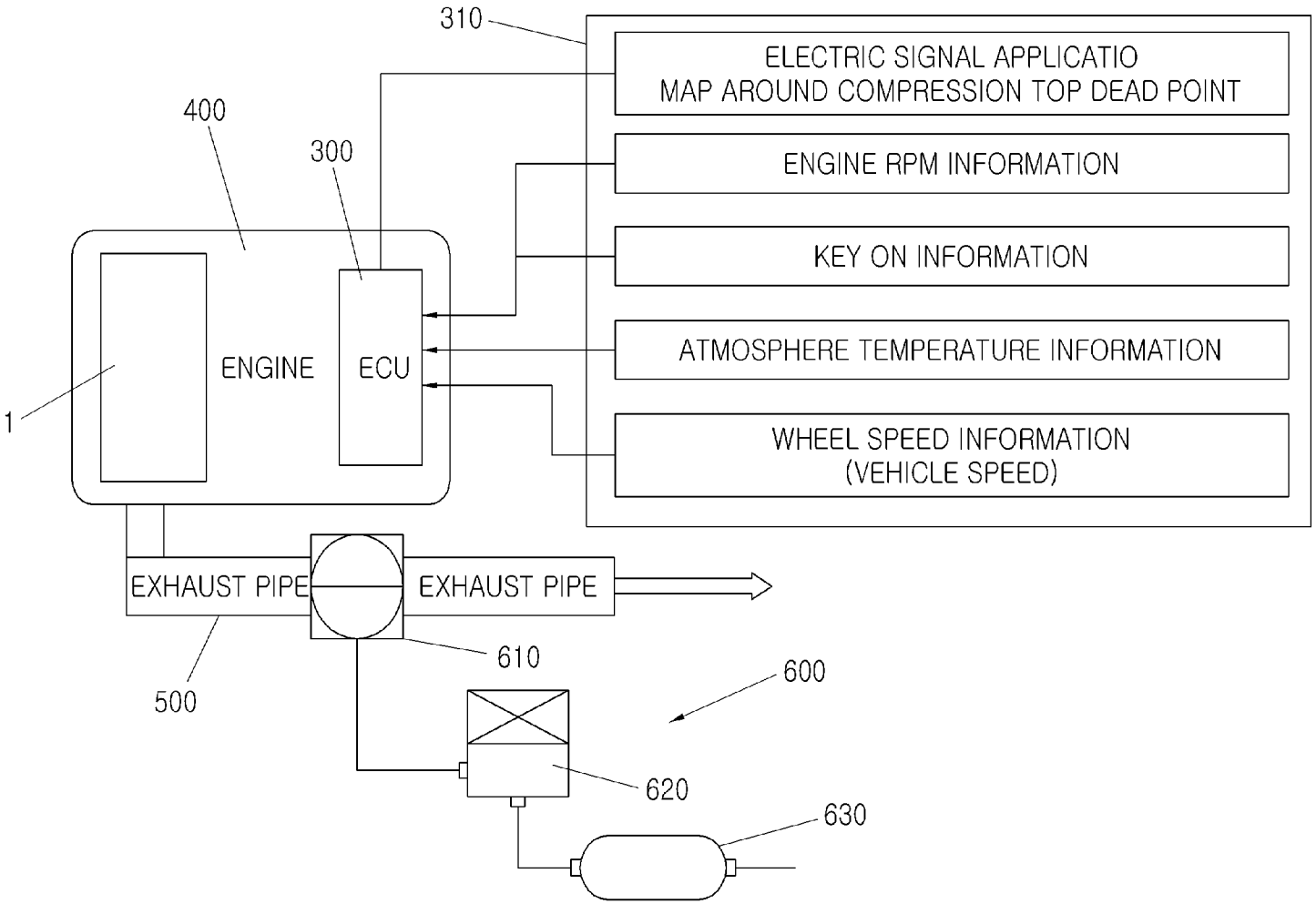
FIG. 9 is a block diagram of a vehicle applying an exhaust cam non connection engine brake as an auxiliary brake according to the present disclosure.

FIG. 9 shows a vehicle applying an exhaust cam non connection engine brake as an auxiliary brake in accordance with an exemplary embodiment of the present inventive concept.

As shown, the vehicle may include an engine 400 applying the variable valve system 100, the engine brake 1 connected with the variable valve system 100, an exhaust brake 600 connected with an exhaust pipe 500 discharging exhaust gas at the engine 400 and the ECU 300 controlling the variable valve system 100, the engine brake 1 and the exhaust brake 600.

The variable valve system 100 and the engine brake 1 are equal to the variable intake/exhaust system shown in FIGS. 2 and 3.

The ECU 300 is same as the ECU 300 shown in FIGS. 2 and 3 in terms of controlling the variable valve system 100 and the engine brake 1, however, the ECU 300 controls the exhaust brake 600 acting as the auxiliary brake along with the engine brake 1.

The exhaust brake 600 may include an exhaust brake valve 610 installed on the exhaust pipe 500 which is connected with the engine 400 for blocking an exhaust gas flow. A solenoid valve 620 is opened and closed by the control of the ECU 300. An air tank 630 provides an air pressure for operating the exhaust brake valve 610 when the solenoid valve 620 is open.

Figure 10:
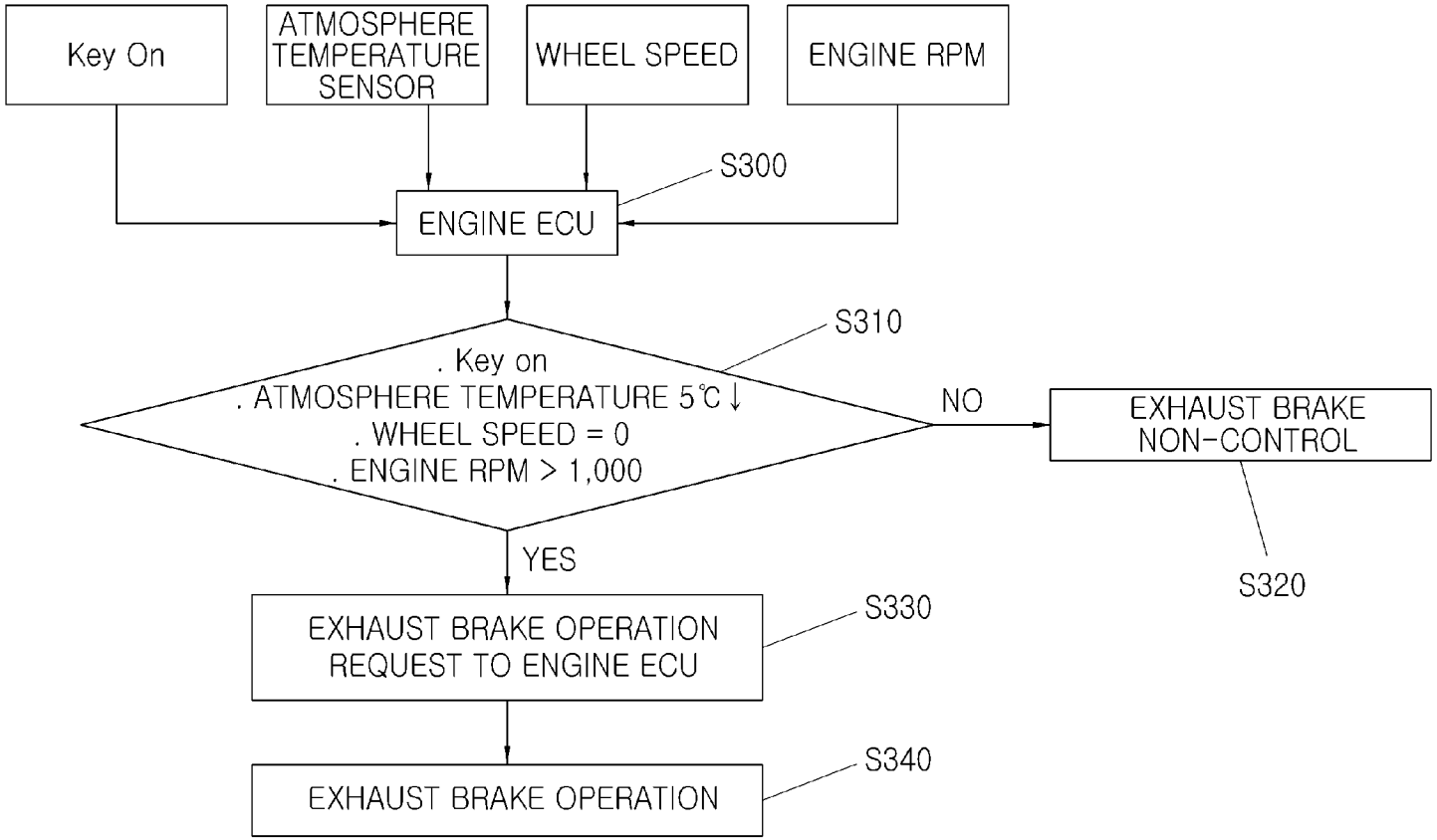
FIG. 10 is an example of the control by which an engine cooling water temperature is risen by an exhaust brake of a vehicle according to the present disclosure.

FIG. 10 is an example of the heating control of engine cooling water that the exhaust brake 600 for assisting vehicle braking power heats the engine cooling water in accordance with the control of the ECU 300.

Engine cooling water temperature rising control starts by the ECU 300 to read an engine RPM, key on state (or IG on state), atmosphere temperature, and wheel speed (or vehicle speed) such as at step S300 and then confirm the conditions of the key on state (or IG on state)=key on (or IG on), the atmosphere temperature <5° C., the wheel speed (or vehicle speed)=0, and the engine RPM >1,000. Hence, "=" means that two values or two states is equal, "<" does that one of two values is greater than the other and ">" does that one of two values is smaller than the other. Particularly, the condition of the atmosphere temperature <5° C. may change in accordance with various vehicle travelling situations. The condition of the wheel speed (vehicle speed)=0 prevents difficulty of starting vehicle by automatic operation of the exhaust brake when a driver makes key on and starts vehicle. The condition of the engine RPM >1,000 is to consider the cause of engine starting off by the operation of the exhaust brake 600 when the engine RPM is less than 1,000 RPM.

As the result of checking step S310, the exhaust brake 600 does not operate so that the engine cooling water temperature rising control is blocked by entering step S320 when the conditions that the key on state (or IG on)=key on (or IG on), the atmosphere temperature <5° C., the wheel speed (or vehicle speed)=0, and the engine RPM >1,000 are not satisfied.

Otherwise, as the result of checking at step S310, the engine cooling water temperature rising is achieved by the ECU 300 by entering into step S330 when the conditions that the key on state (or IG on)=key on (or IG on), the atmosphere temperature <5° C., the wheel speed (or vehicle speed)=0, and the engine RPM >1,000 are satisfied.

Figure 11:
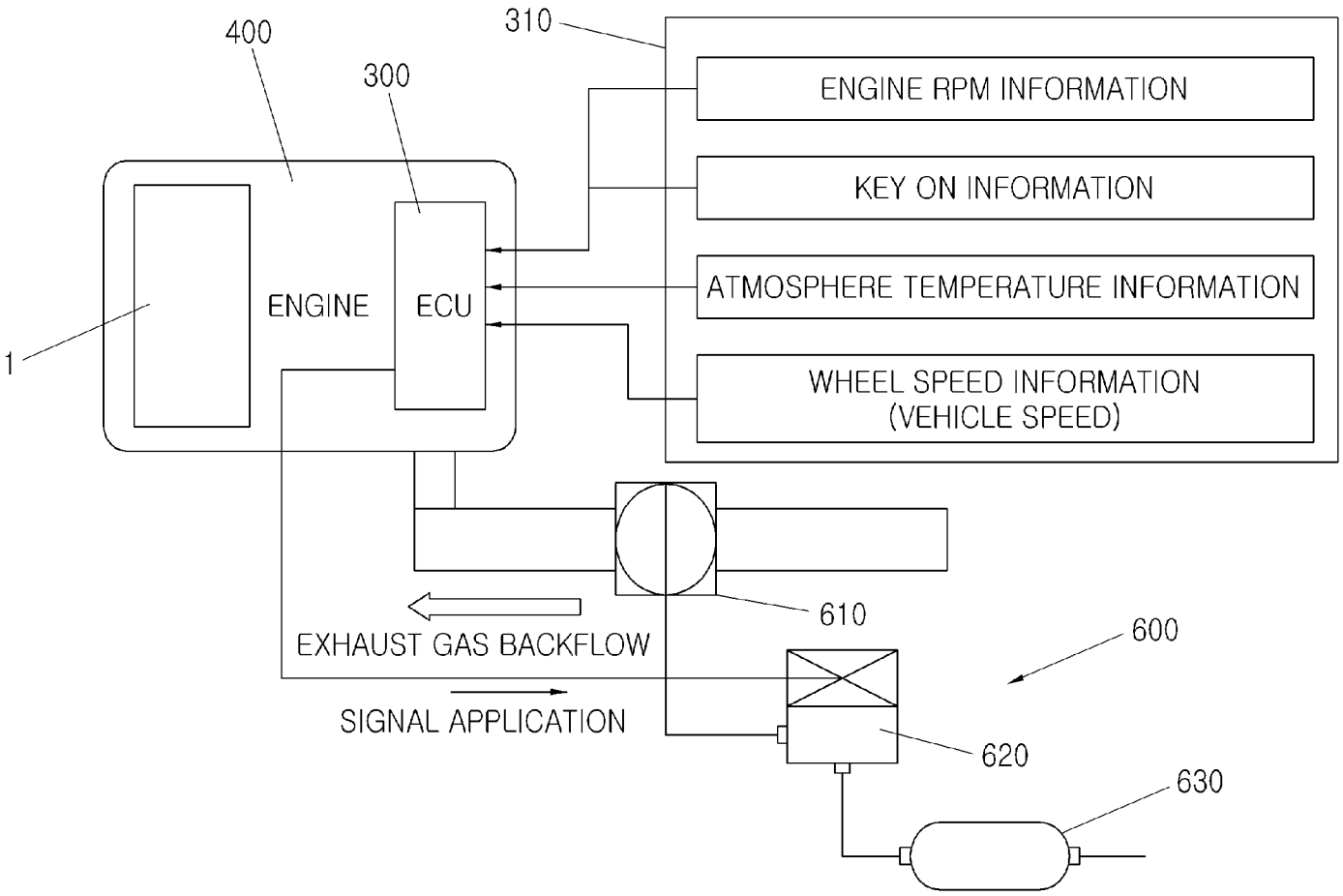
FIG. 11 shows an operation state of the exhaust brake shown in FIG. 10.

FIG. 11 shows the operation of the exhaust brake of step S400. As shown, the ECU 300 applies an electric signal to the solenoid valve 620, and then, the line connected to the exhaust brake valve 610 is open by the solenoid valve 620 in accordance with the electric signal application so that the air pressure of the air tank 630 operates the exhaust brake valve 610. Then, the exhaust brake valve 610 is open by the air pressure to close the exhaust pipe 500 and prevent external discharging of the exhaust gas, and the exhaust gas blocked external leakage flows backward toward the combustion chamber of the engine 400. Due to this, the engine 400 is heated by the hot exhaust gas so that the engine cooling water circulating the engine 400 is heated by the hot exhaust gas heat.

As described above, the exhaust cam non connection engine brake according to the exemplary embodiment includes the master piston 20 making the high pressure oil stored in the high pressure storing chamber 11 of the housing body 10 to the low pressure oil, a slave piston 30 operated by the high pressure oil in order to open the exhaust rocker arm 120, multiple valves 40, 50, 60, 70 controlling a low pressure oil supply flow connected to the master piston 20, a high pressure oil supply flow connected to the slave piston 30, and a high pressure oil discharge flow supplied to the slave piston 30, and an oil circulating passage 20-1, 30-1, 50-1, 60-1, 70-1, 80-1 formed at the housing body 10 for circulating the high pressure oil and the low pressure oil, so that it may be easily applied to the variable intake/exhaust valve system 100 by the operation of the exhaust valve 130-1, 130-2 without a mechanical connection structure with the exhaust cam, and particularly, may expand the usage area of the exhaust brake by applying the exhaust brake 600 as an auxiliary brake to a vehicle along with the engine brake 1 so that the exhaust brake 600 is used in engine cooling water temperature rising other than the brake assist.

What is claimed is:

1. A vehicle having an exhaust cam non connection engine brake as an auxiliary brake, comprising:

a variable valve system mounted at a cylinder head of an engine and including an exhaust cam, an exhaust rocker arm, an intake valve, an exhaust valve, a cam cap, and a cam shaft to vary an opening time between the exhaust valve and the intake valve for each engine RPM;

an exhaust cam non connection engine brake which converts a low pressure oil to a high pressure oil to supply the high pressure oil toward the exhaust rocker arm so that the exhaust rocker arm presses the exhaust valve by the high pressure oil when an engine brake signal is applied; and an electronic control unit (ECU) controlling the variable valve system and having an compression top dead center electric signal application map for an engine brake operation and release control.

2. A vehicle having an exhaust cam non connection engine brake as an auxiliary brake, comprising:

a variable valve system mounted at a cylinder head of an engine and including an exhaust cam, an exhaust rocker arm, an intake valve, an exhaust valve, a cam cap and a cam shaft to make a difference in an opening time between the exhaust valve and the intake valve for each engine RPM;

an exhaust cam non connection engine brake which converts a low pressure oil to a high pressure oil to supply the high pressure oil toward the exhaust rocker arm so that the exhaust rocker arm presses the exhaust valve by the high pressure oil when an engine brake signal is applied;

an exhaust brake connected to an exhaust pipe discharging exhaust gas from the engine; and an ECU controlling the variable valve system and the exhaust brake, and having a compression top dead center electric signal application map for an engine brake operation and release control.

3. The vehicle of claim 2, wherein the exhaust brake includes:

an exhaust brake valve installed at the exhaust pipe connected with the engine to block an exhaust gas flow;

a solenoid valve opened and closed by the control of the ECU; and an air tank providing an air pressure for the operation of the exhaust brake valve when the solenoid valve is open.

4. An exhaust cam non connection engine brake, comprising:

a housing body having a high pressure storing chamber which converts a low pressure oil to a high pressure oil and stores therein in order to allow the high pressure oil to flow toward an exhaust rocker arm so that the exhaust rocker arm presses an exhaust valve by the high pressure oil when an engine brake signal is applied.

5. The exhaust cam non connection engine brake of claim 4, wherein the low pressure oil is supplied through a cam cap mounted at a cylinder head, and the high pressure oil is discharged out toward the cylinder head.

6. The exhaust cam non connection engine brake of claim 4, further comprising a variable intake/exhaust valve system varying an opening time between the exhaust valve and an intake valve for each engine revolutions per minute (RPM).

7. The exhaust cam non connection engine brake of claim 4, wherein the housing body includes a regulation valve installed at a relief oil line and relieving an overpressure of the high pressure storing chamber mounted at the housing body.

8. The exhaust cam non connection engine brake of claim 4, wherein the housing body includes:

a master piston converting the high pressure oil to the low pressure oil;

a slave piston operating by the high pressure oil and pressing the exhaust rocker arm to open the exhaust valve;

a pair of high speed and low speed valves, which are installed at the housing body, operated by an electric signal application and receiving the low pressure oil for forming a supply flow of the high pressure oil and a discharge flow of the high pressure oil supplied to the slave piston;

a pair of a first shuttle valve and second shuttle valve installed at the housing body and operated by the pair of high speed and low speed valves, respectively; and an oil circulating passage formed at the housing body and including a master oil line letting the high pressure oil converted from the low pressure oil out, a slave line in which the high pressure oil flows, a first oil inflow line in which the low pressure oil comes, an oil discharge line through which the high pressure oil is discharged, and a second oil inflow line in which the low pressure oil comes.

9. The exhaust cam non connection engine brake of claim 8, wherein the master oil line is branched at the first oil inflow line and connected to the master piston and the high pressure storing chamber, the slave oil line forms the supply flow of the high pressure oil connected with the slave piston through the high pressure storing chamber, the high speed valve, and the first shuttle valve, the first oil inflow line is connected to the high speed valve, the oil discharge line is connected with the second shuttle valve to form the discharge flow of the high pressure oil, and the second oil inflow line is connected to the low speed valve.

10. The exhaust cam non connection engine brake of claim 9, wherein the master oil line is branched at the first oil inflow line and divided into a line connected to the master piston for the low pressure oil to enter therein and a line connected to the high pressure storing chamber for the high pressure oil to be discharged, and a check valve for one way flow is installed at the lines, respectively.

11. The exhaust cam non connection engine brake of claim 8, wherein, when the engine brake becomes an operation standby state, the low speed valve is open by an engine brake operation signal non-application so that the low pressure oil enters the low speed valve through the second oil inflow line, and the second shuttle valve discharges the high pressure oil supplied to the slave piston through the oil discharge line by the openness of the low speed valve.

12. The exhaust cam non connection engine brake of claim 8, wherein, when the engine brake becomes an operation state, the low speed valve is closed by an operation signal application, the second shuttle valve blocks the oil discharge line, the high speed valve is open by the operation signal application so that the low pressure oil enters into the first oil inflow line, the high pressure oil is supplied to the slave oil line by the movement of the first shuttle valve resulted from the inflow of the low pressure oil, and the high pressure oil is flowed into the slave piston through the slave oil line.

13. The exhaust cam non connection engine brake of claim 8, wherein the housing body further includes a regulation valve for relieving an overpressure of the high pressure storing chamber, the regulation valve is installed at a relief oil line connected to the high pressure storing chamber, and when the engine brake becomes an operation state, the regulation valve is open by oil pressure in the high pressure storing chamber to relieve the overpressure of the high pressure oil.

14. The exhaust cam non connection engine brake of claim 8, wherein, when the engine brake becomes a return state, the high speed valve is closed by blockage of the electric signal application, the first shuttle valve moves by the low pressure oil inflow through the first oil inflow line to block the high pressure oil supply of the slave oil line, and the low speed valve is open by the engine brake operation signal application to the second shuttle valve by the low pressure oil inflow through the second oil inflow line, thereby discharging the high pressure oil supplied to the slave piston through the oil discharge line.

15. A method for controlling an exhaust cam non connection engine brake as an auxiliary brake, the method comprising:

recognizing, by an ECU, an engine RPM, ignition (IG) on state, an atmosphere temperature, and a vehicle speed to enter an engine brake ready state, and determining, by the ECU, whether the atmosphere temperature is less than a predetermined temperature, the vehicle speed is 0 (zero), and the engine RPM is more than 1,000 rpm during the IG on state and an engine cooling water rising control state temperature by operating an exhaust brake.

16. The method of claim 15, further comprising:

operating the exhaust brake is operated so that hot exhaust gas from an engine due to blockage of an exhaust pipe by an exhaust brake valve may flow backward to an combustion chamber of the engine.

* * * * *